United States Patent [19]

Nakagaki et al.

[11] 4,370,871

[45] Feb. 1, 1983

[54] WARP KNITTED NARROW LACE AND PROCESS FOR PREPARATION THEREOF

[75] Inventors: Noboru Nakagaki; Hroaki Fujikawa, both of Fukui, Japan

[73] Assignee: Takeda Lace Co. Ltd., Fukui, Japan

[21] Appl. No.: 90,534

[22] Filed: Nov. 2, 1979

[30] Foreign Application Priority Data

Nov. 4, 1978 [JP] Japan ..... 53-136081

[51] Int. Cl.[3] ..... D04B 7/16

[52] U.S. Cl. ..... 66/202; 28/168

[58] Field of Search ..... 66/192, 193, 195, 202; 28/168

[56] References Cited

U.S. PATENT DOCUMENTS 2,365,315 12/1944 Williams ..... 28/168
4,096,610 6/1978 Bassist ..... 28/159

FOREIGN PATENT DOCUMENTS 2079718 11/1971 France ..... 66/202
2297277 8/1976 France ..... 28/168
48-4231 2/1973 Japan ..... 66/193

OTHER PUBLICATIONS

Paling, D. F., "Warp Knitting Technology", 2nd Ed., 1965 Columbine Press, London, pp. 272 to 288.
Wheatley, B., "Raschel Lace Production", 1972 Ktd. Outer Assoc., N.Y., pp. 141 to 155.

*Primary Examiner*—Ronald Feldbaum
*Attorney, Agent, or Firm*—Amster, Rothstein & Engelberg

[57] ABSTRACT

Disclosed is a warp knitted narrow lace and method of forming the same in which purls or decorative loops are formed in a curved line along curved scallops of the lace. This warp knitted narrow lace is manufactured by knitting the base fabric into a Raschel lace having a scalloped edge and simultaneously knitting laid in yarns into the edges forming the scalloped edge of the lace in such manner that the laid in yarns are laid in with stitches of soluble yarns and/or ravel yarns located outside base fabric at the outermost portion of the scalloped edge and with stitches of the base fabric in the indentations of the scallops. Dissolving the soluble yarns and/or pulling out the ravel yarns in the area of the outermost edge of the scallops, and cutting the stitches of the base fabric outwards of the purls in the indentations of the scallops results in the formation of a novel lace having purls formed in a curved line along the entire scallops.

1 Claim, 2 Drawing Figures

WARP KNITTED NARROW LACE AND PROCESS FOR PREPARATION THEREOF

BACKGROUND OF THE INVENTION (1) Field of the Invention

The present invention relates to a warp knitted narrow lace and a method for the preparation thereof.

(2) Description of the Prior Art

In conventional warp knitted Raschel laces, even if wavy edges are formed by using pattern yarns, picots, purls or decorative extending loops extending along these curvy edges cannot be formed by knitting, but extending loops can be formed only in a straight line and even then, only on the outermost straight edge of curved scallops.

SUMMARY OF THE INVENTION

It is a primary object of the present invention to provide a novel warp knitted narrow lace in which purls or decorative loops are formed along the entire curved lines of curved scallops and which gives a quite different appearance from a conventional lace fabric in which extending loops are formed only along the outermost edge of the lace.

Another object of the present invention is to provide a process for the preparation of this novel warp knitted narrow lace.

In accordance with one aspect of the present invention, there is provided a novel warp knitted narrow lace comprising a Raschel lace having curved scallops formed by knitting a base fabric. Decorative extending loops are formed by knitting laid in yarns into the outermost edge of the curved portions of the scallops, and by laying laid in yarns with the stitches of the lace in the indentations of the curved portions of the scallops. The stitches in the indentations of the lace located outwardly of the so formed purls are cut and removed.

In accordance with the other aspect of the present invention, there is provided a process for preparation of warp knitted narrow lace comprising the steps of knitting the base fabric into a Raschel lace having a scalloped edge with soluble or dissolving yarns and/or unknitting or ravel yarns for a plurality of wales disposed outwardly of the base fabric along the outermost edge of the curve portion of the scallops. Knitting laid in yarns in stitches simultaneously with knitting of the base fabric forming the outermost edge of the scallops so that the laid in yarns are laid in with stitches of the soluble yarns and/or the ravel yarns along the outermost edge of the scallops and with stitches of the base fabric in the indented portions of the scallops. Dissolving the soluble yarns and/or pulling out the ravel yarns from the decorative loops projecting from the outermost edge of the scallops, and cutting the stitches of the base fabric located outwardly of the decorative loops in the indentations of extending scallops to remove them, whereby the decorative loops are formed in a curved line along the whole edge of the scallops.

In accordance with another aspect of the present invention, there is provided a process for the preparation of warp knitted narrow lace comprising the steps of knitting the base fabric into a Raschel lace having a scalloped edge with soluble yarns and/or ravel yarns for a plurality of wales located outwardly of the base fabric along the outermost edge of the curved portion of the scallops and further with a plurality of stitch yarns being disposed outwardly of said rows of the soluble yarns, etc. to be connected thereto by connecting insert yarns. Knitting laid in yarns into stitches simultaneously with knitting of the base fabric forming the outermost pattern yarns edge of the scallops so that the laid in yarns are laid in with stitches of the soluble yarns and/or the ravel yarns along the outermost edge of the scallops and with stitches of the base fabric in the indented portions of the scallops. Dissolving the soluble yarns and/or pulling out the ravel yarns from the decorative loops projecting from the outermost edge of the scallops and removing stitches of the base fabric located outwards of the decorative loops in the indentations of the scallops by cutting means, whereby purts are formed in a curved line along the entire scallops.

Further, in the present invention it is intended to develop the processes to manufacture warp knitted narrow lace in which purls are formed on both sides of the lace along the curved lines of the scallops formed on their both sides.

BRIEF DESCRIPTION OF THE DRAWINGS

The above brief description, as well as further objects, features and advantages of the present invention will be more fully understood by reference to the following description of the presently preferred, but nonetheless illustrative embodiment, in accordance with the present invention, when taken in conjunction with the accompanying drawings, wherein.

DETAILED DESCRIPTION OF THE PREFERRED EMBODIMENTS

The present invention will now be described with reference to embodiments shown in the accompanying drawings.

Figure 1:
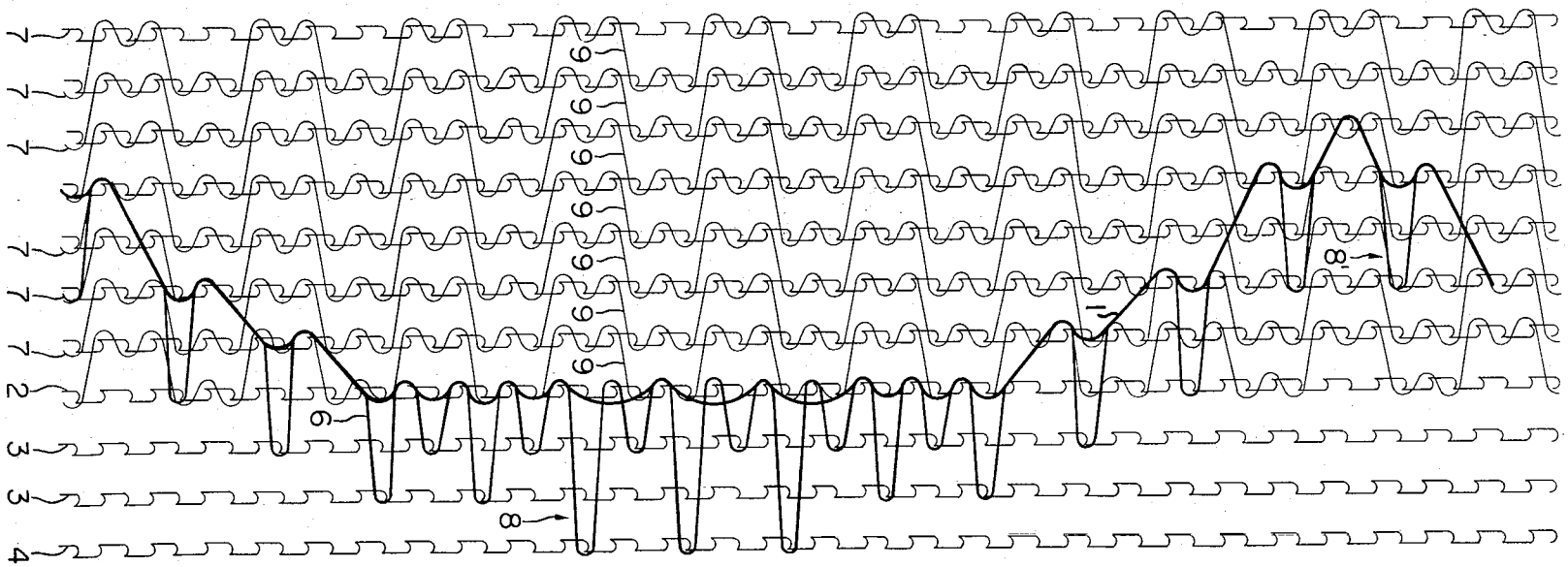
FIG. 1 is a diagram illustrating the texture of a warp knitted narrow lace fabric according to one embodiment of the present invention along with the process for the preparation thereof.

In one embodiment of the present invention, decorative extending loops or purls are formed along curved edges of entire curved scallops. In the warp knitted narrow lace of this embodiment, as shown in FIG. 1 purls 8 are formed by knitting on the outermost edge of the curved portions of scallops 1. The chain stitches 7 forming the base fabric are laid in with laid in threads in the area of the indentation along the edge of the curved portions of the scallops to form purls 8'. Stitches of the base fabric located outwardly of the purls 8' formed in indentation of the scallops 1 are cut and removed. Thus, a series of purls are formed in a curved line along the curved scallops 1.

Figure 2:
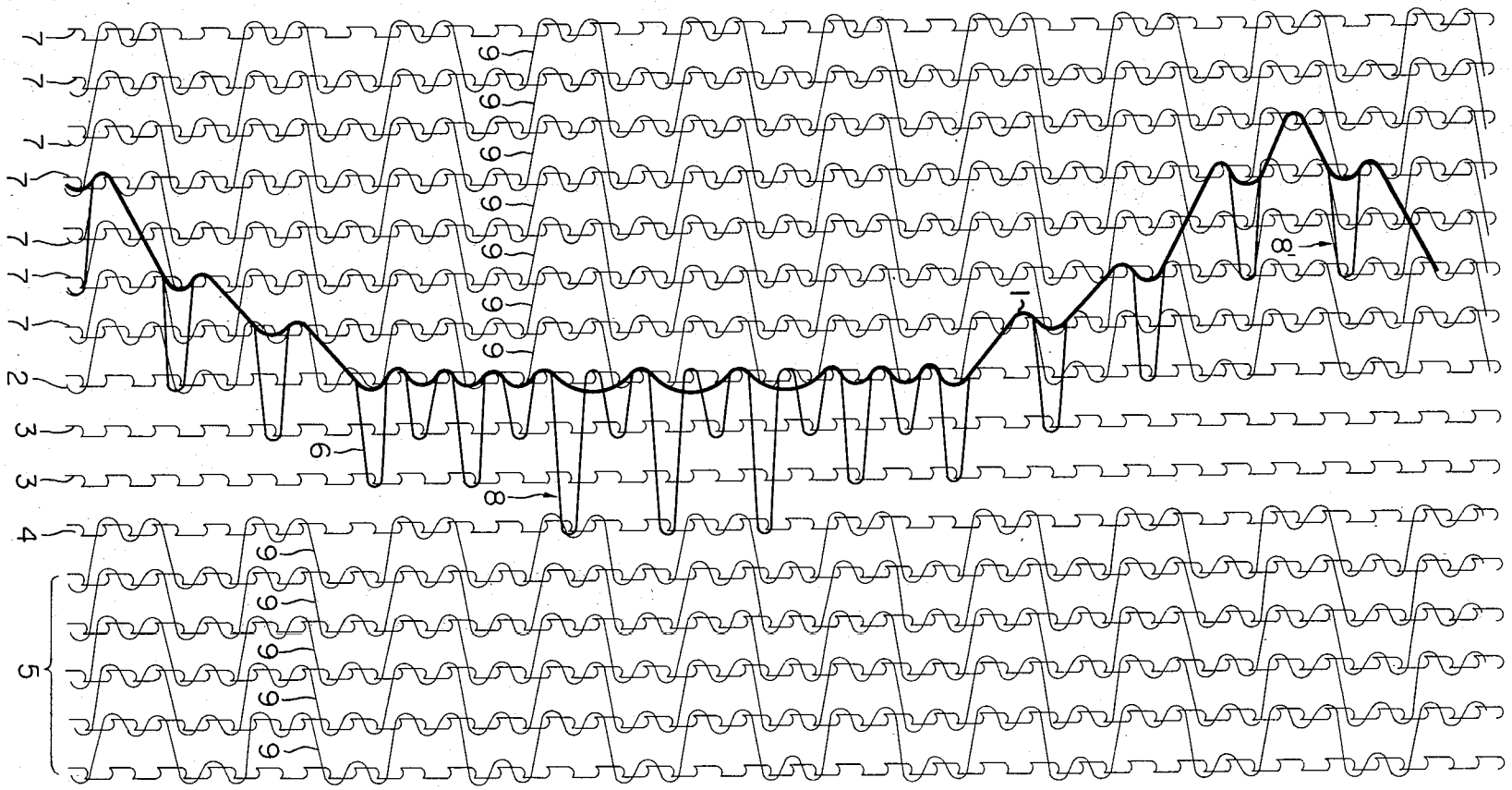
FIG. 2 is a diagram illustrating another process for preparation of the warp knitted narrow lace fabric shown in FIG. 1.

Embodiments of the process for the preparation of the warp knitted narrow lace of the present invention will now be described with reference to FIGS. 1 and 2.

According to one embodiment of the process of the present invention, purls are formed by entangling laid in yarns with stitches of the base fabric and stitches of soluble yarns or ravel yarns. Referring to FIG. 1, in a warp knitted Russel lace, scallops 1 having a curved portion are formed by knitting the base fabric. Soluble yarns 3 and/or ravel yarns 4 are used in a plurality of wales of stitches located outwardly of stitches 2 with forming the outermost edges of the curved portions of the scallops. A water-soluble yarn, a heat-fusible yarn, or organic solvent soluble yarn and the like can be used as the soluble yarns 3. Simultaneously with knitting of outermost pattern yarns of the scallops 1, purls 8 and 8' are formed when yarns 6 are knitted in stitches. More specifically, in the outermost edge the scallops 1, yarns for forming purls 8 are laid in with stitches of the soluble yarns 3 and/or ravel yarns 4 to form purls 8, and in indentations of the scallops 1, yarns for forming purls 8' are laid in with chain stitches 7 of the base fabric. After this knitting operation, the soluble yarns 3 are dissolved by dipping in water, heating or treating with organic solvents, or the like, and/or the ravel yarns 4 are pulled out from purls 8, and stitches located outwardly of purls 8' in the indentations of the scallops 1 are cut to be removed. Thus, a knitted lace in which a series of purls 8 and 8' are arranged in a curved line along the entire curved scallops 1 is produced.

Another embodiment of the process of the present invention will now be described with reference to FIG. 2.

In this embodiment, the outermost stitches of soluble yarns 3 or ravel yarns 4 with which purls 8 are to be entangled are connected to stitches disposed outwardly of the wales formed by yarns 3, 4. That is, in a warp knitted Raschel lace, scallops 1 having a curved portion are formed by knitting pattern yarns. Soluble yarns 3 such as water soluble yarns, heat fusible yarns or organic solvent soluble yarns and/or ravel yarns 4 are used as to form a plurality of wales located outwardly of stitches 2 with which the pattern yarns in the outermost edge of the scallops are laid in. Further chain stitches 5 are formed outside soluble yarns 3 in the pattern yarns of the lace fabric, and the stitches 5 are laid in with connecting insertion yarns 9. Simultaneously with knitting of the outermost pattern yarns of the scallops 1, purls 8 and 8' are formed when yarns 6 are knitted in stitches. More specifically, yarns for forming purls 8 are laid in with stitches of the soluble yarns 3 and/or the ravel yarns 4 in the most projected parts of the scallops, and in the indentations of the scallops 1, the yarns 6 are laid in with chain stitches 7 of the yarns of the base fabric to form purls 8'. Then, the soluble yarns 3 are dissolved and/or the ravel yarns 4 are pulled out from purls 8. Stitches located outwardly of the purls 8' in the indentations of the scallops 1 are removed by cutting. Thus, a series of purls 8 and 8' are formed in a curved line along the entire curve of the scallops 1.

In accordance with one preferred embodiment of the present invention, scallops are formed on both sides of the lace, and purls or decorative extending loops are formed along the scallops on both sides of the lace fabric. This embodiment can be manufactured by either one of the processes above-mentioned.

As will be apparent from the foregoing, according to the present invention purls 8 are formed by laying in the laid in yarns with stitches of soluble yarns 3 and/or ravel yarns 4, and after the knitting operation, the soluble yarns 3 being dissolved and/or the ravel yarns 4 are pulled out, and stitches of the base fabric located outwardly of purls 8' are removed by cutting. Accordingly, purls arranged in a curved line along scallops can be formed, and the resulting narrow lace has a more decorative appearance than conventional lace having purls arranged in a straight line.

Furthermore, in the process of the above-mentioned second embodiment, the outermost stitches of the soluble yarns 3 and/or the ravel yarns 4 are connected to stitches 5 of the yarns of the base fabric by using connecting insert yarns 9. Accordingly, purls 8 can be stably laid in with the outermost stitches of the soluble yarns and/or the ravel yarns and the projection length, long or short, of the purls, is each uniformalized. Therefore, beautiful purls are arranged in a regular curved line.

According to the above-mentioned preferred embodiment, purls can be formed along curved scallops formed on both sides of a warp knitted narrow lace.

Therefore, various characteristic effects can be attained according to the present invention.

The present invention is not limited to the embodiments described and illustrated, instead they may be subjected to various changes and modifications without departing from the scope of the invention.

What is claimed is:

1. A warp knitted narrow lace fabric having a scalloped edge with decorative loops or purls along substantially the entire scalloped edged comprising a Raschel lace base fabric having curved scallops with outermost portions and indented portions formed by knitting a pattern in the base fabric, purls formed by knitting laid in yarns on the outermost portions of said scallops and purls formed by laying in laid in yarns with stitches of the base fabric in the indentations of the scallops, the stitches of said base fabric located outwardly of said purls in said indentations being cut and removed.

* * * * *